United States Patent [19]

Batra, deceased et al.

[11] Patent Number: 4,812,071

[45] Date of Patent: Mar. 14, 1989

[54] CORRECTION FLUID PEN

[76] Inventors: Pran Batra, deceased, late of Clarks Summit; by Shanta Batra, legal representative, 502 Fawnwood Dr., Clarks Summit, both of Pa. 18411

[21] Appl. No.: 142,086

[22] Filed: Jan. 7, 1988

Related U.S. Application Data

[63] Continuation-in-part of Ser. No. 900,841, Aug. 27, 1986, abandoned.

[51] Int. Cl.[4] ..... B43K 1/06; B43K 8/00

[52] U.S. Cl. ..... 401/264; 401/260

[58] Field of Search ..... 222/92, 107; 401/261, 401/264, 263, 183, 260

[56] References Cited

U.S. PATENT DOCUMENTS

| | | | |
|---|---|---|---|
| 236,222 | 1/1881 | Hawkes | 401/260 |
| 748,383 | 12/1903 | Langill | 401/260 |
| 1,540,082 | 6/1925 | Merrill | 401/260 X |
| 2,339,464 | 1/1944 | Deskey | 222/92 |
| 2,714,475 | 8/1955 | Roehrich | 401/183 |
| 3,151,777 | 10/1964 | Rooney | 222/92 |
| 3,229,866 | 1/1966 | Arbitman et al. | 401/263 |
| 3,832,071 | 8/1974 | Chaney | 401/260 |
| 4,461,408 | 7/1984 | Shepard | 401/260 X |
| 4,511,273 | 4/1985 | Trotta | 401/260 |
| 4,572,691 | 2/1986 | Kirchhoff et al. | 401/260 X |
| 4,685,820 | 8/1987 | Kremer et al. | 401/260 |

FOREIGN PATENT DOCUMENTS

| | | | |
|---|---|---|---|
| 63651 | 11/1912 | Switzerland | 401/260 |

*Primary Examiner*—Richard J. Apley
*Assistant Examiner*—Franklin L. Gubernick
*Attorney, Agent, or Firm*—Angelo Notaro

[57] ABSTRACT

A correction fluid pen for applying a correction fluid, the correction fluid being of the type containing an opaque covering pigment and a volatile solvent. The pen includes a barrel with a manually squeezable plastic wall portion and an applicator with a spring biased stylus. The squeezable plastic wall portions advantageously have a bellows structure to facilitate the manual squeezing operation. The stylus is positioned within an orifice assembly which includes an orifice for passing the correction fluid. A portion of the stylus is moveable toward an exit opening for the orifice assembly for metering correction fluid passing out of the orifice assembly.

13 Claims, 2 Drawing Sheets

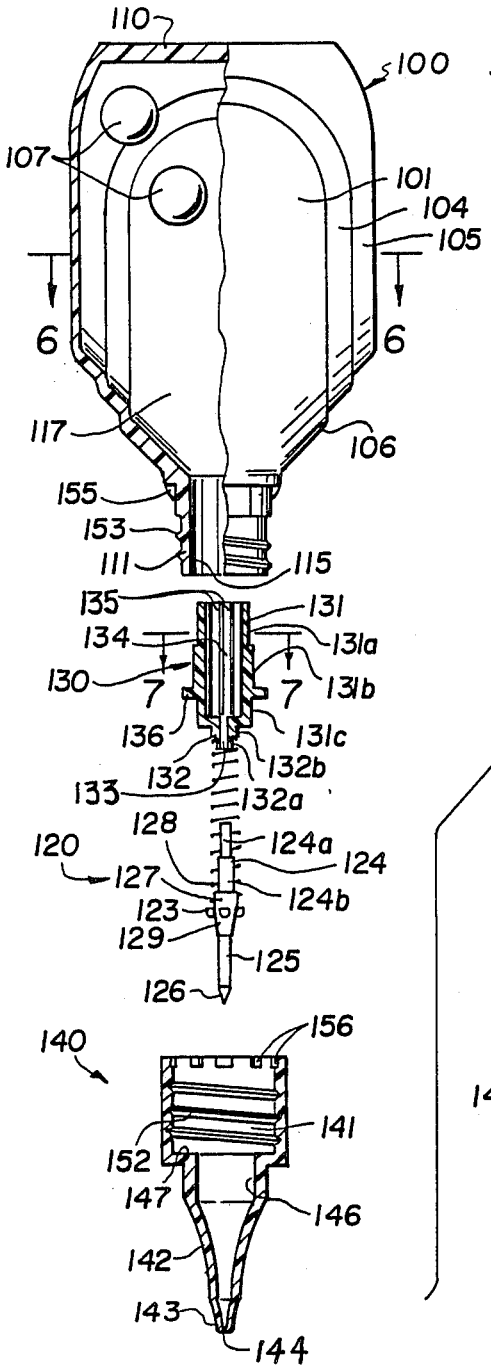
FIG. 5
FIG. 6
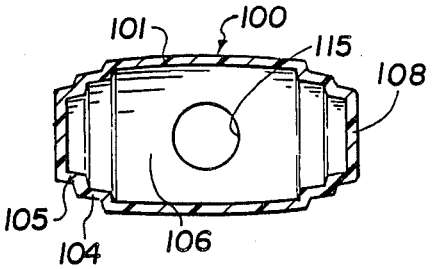
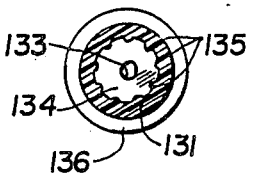
FIG. 7
FIG. 8
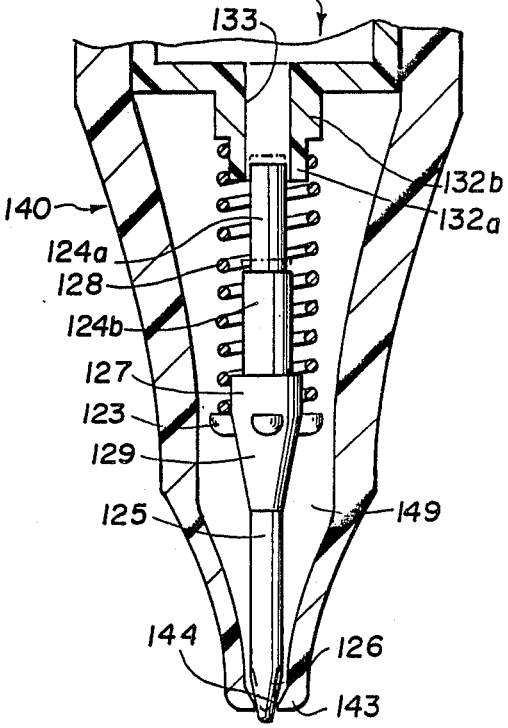

CORRECTION FLUID PEN

CROSS REFERENCE TO RELATED APPLICATION

This is a continuation-in-part application of the co-inventor's previous application having Ser. No. 900,841, filed Aug. 27, 1986, now abandoned.

BACKGROUND OF THE INVENTION

This invention relates to a correction fluid applicator, in pen form, for conveniently and precisely applying a pigmented correction fluid in limited or sustained amounts.

Correction fluids have been used in offices and elsewhere for many years to cover hand-written and typewritten errors on paper and, as well, to generally touch-up the appearance of paperwork. Typically, such fluids contain a pigment matching the color of the paper on which the correction is to be made and a volatile fluid that carries the pigment and is designed to evaporate on the paper so as to leave a coating of the pigment over the error which obscures the error.

Correction fluids are most often sold in a bottle having a cap with a brush on the end of a stem extended into the bottle. The correction fluid is brushed onto the error. Due to the volatile nature of the fluid, if the bottle is left open, or the brush laid aside, the fluid in the bottle and on the brush will evaporate. Partial or total fluid evaporation may occur if the bottle is not tightly sealed. Correction fluids provided in bottles, moreover, are susceptible to spills. In addition, difficulty may be experienced when it is necessary to precisely apply a tiny amount of correction fluid, for example, on a single typewritten letter, due to the width of the brush. Pigment residue dried on the brush, or disorientation of the fibers of the brush that may result from normal wear, or excessive pressure, also makes it difficult to precisely apply the correction fluid. As the brush can carry only a limited quantity of fluid, it is necessary to repeatedly dip the brush into the fluid in the bottle when correcting larger errors. In such cases, it is difficult to assure the application of an even thickness of coating, time is wasted each time the brush is removed from the paper, and there is an increased possibility of accidental spills or mis-application of the brush as it is returned to the paper.

Various correction fluid pens have been marketed or suggested which are designed to resolve some of the aforementioned problems. One pen form includes a brush within a tube. The tube is tilted to allow the brush to slide out of the tube and inverted to retract the brush. It has been found, however, that this pen form has many of the same infirmities of the bottle and brush applicators. Moreover, drying of the fluid on the brush or disorientation of the brush fibers interferes with the sliding motion of the brush. This type of applicator has not been capable of evenly applying sustained amounts of correction fluid to larger errors.

A pen-like applicator for applying correction fluid, including spring-loaded ball or tip, has been suggested. The applicator is secured to the housing in fluid communication with the correction fluid. The applicator is typically spring-loaded so that the applicator is biased to close a discharge orifice when the pen is not in use. In operation, pressure applied to the ball tip causes the ball to retract and thereby permits flow to occur.

Nevertheless, spring-loaded correction fluid pens on the market have been found to be deficient in failing to provide means for preventing or dealing with the tendency of the correction fluid to cake and clog the discharge orifice, or lacking in means to assure a sustained, even flow of correction fluid, e.g., when an entire paragraph is to be corrected.

SUMMARY OF THE INVENTION

It is an object of the invention to provide a correction fluid pen that is capable of applying correction fluid in sustained or limited amounts The correction fluid pen, according to the invention, has a squeezable barrel, a rigid spring-loaded fluid applicator tip and a specially-formulated formulation of correction fluid, having liquid content of at least seventy weight percent.

In accordance with a preferred embodiment of the invention, the barrel comprises a plastic container which is slightly squeezable on the application of manual pressure applied by pressing the barrel between a user's forefinger and thumb.

The barrel preferably has a substantially rectangular cross-section. The side walls of the barrel also advantageously have stepped portions to form a bellows.

An applicator assembly located at the bottom end of the barrel is provided which includes a cavity for housing the stylus which is slidably mounted therein. An orifice assembly mounted within an opening in the lower end of the barrel provides means for metering correction fluid into the cavity. The assembly, in a preferred embodiment, includes a cylindrical boss. A conical spring is mounted on the boss at one end and on the stem of the stylus, at an opposite end, in order to bias the stylus into engagement with a body portion of the applicator assembly. Complementary conical portion on the stylus and a funnel-shaped portion on the body of the applicator assembly are pressed together by the spring to seal the discharge of the pen when it is not in use.

BRIEF DESCRIPTION OF THE DRAWINGS

In the accompanying drawings, forming a part of the specification, and in which reference numerals shown in the drawings designate like or corresponding parts throughout the same:

FIG. 5 is a view similar to FIG. 1, showing a further embodiment of the invention;

FIG. 6 is a sectional view taken along lines 6—6 of FIG. 5;

FIG. 7 is an enlarged sectional view taken along lines 7—7 of FIG. 5; and FIG. 8 is an enlarged view of the tip area for the correction fluid pen of FIG. 5.

DETAILED DESCRIPTION

Figure 1:
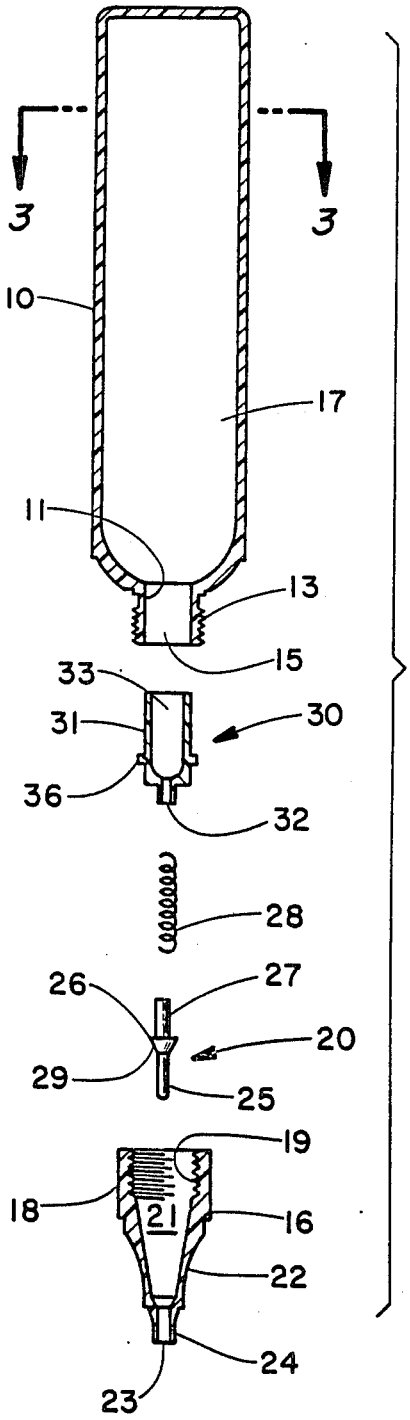
FIG. 1 is an exploded section sectional view of a correction fluid pen embodying the invention.

Referring now to the drawings in detail, there is shown an elongated correction fluid pen. The pen includes a squeezable tubular barrel 10 and an applicator assembly 12. A tapered neck 11, provided at one end of the barrel 10, has external threads 13 and a bore 15 which extends through the neck 10 and communicates with a chamber which contains a fluid reservoir 17 within the barrel. The end of the elongated barrel opposite the neck 11 is close-ended.

The applicator assembly 12 is composed of a carrier body 16 which includes a larger cylindrical portion 18 that is internally threaded, at 19, for threaded engagement to the external threads 13 of the barrel 10, a smaller cylindrical portion 24 and an intermediate funnel-shaped portion 22 interconnects the two cylindrical portions 18, 24. The carrier body 16 includes a cavity 21 which opens to a discharge opening 23. The carrier body 21 houses a solid stylus 20.

The stylus 20 has a cylindrical tip 25 that is slidably mounted in the smaller cylindrical portion 24 and is designed to extend through the discharge opening 23. The tip 25 is attached to a conical portion 29 on one side of a shoulder 26 and a spring support stem 27 is provided on the opposite side of the shoulder 26.

A helical spring 28, mounted about the support stem 27, at one spring end, is seated upon the shoulder 26. At the opposite spring end, the spring is engaged to an orifice assembly 30.

The orifice assembly 30 has a cylindrical tubular section 31 designed to be frictionally engaged with the internal wall surface of the neck 11, within the bore 15, and a boss having an orifice 32 at the lower end of the tubular section 30. A flange 36, extending around the tubular section 31, acts as a stop which prevents the orifice assembly from being pushed into the fluid reservoir 17. One end of the spring 28 is acts as a bearing surface for one end of arranged about the boss.

A passage 33 extends through the cylindrical tubular section 31 and the orifice 32 to permit flow of correction fluid from the fluid reservoir 17, in a metered rate, out through the orifice 31 into the cavity 21.

The spring 28 resiliently urges the stylus 20 toward the discharge opening 23 into engagement with the carrier body 16 so that the conical portion 21 of the stylus 20 is seated on the funnel-shaped portion 22 of the carrier body 16 to seal the applicator assembly against the discharge of fluid. The extreme end of the tip 25, in this closed position, extends through the discharge opening 23 to the outside of the pen.

Figure 2:
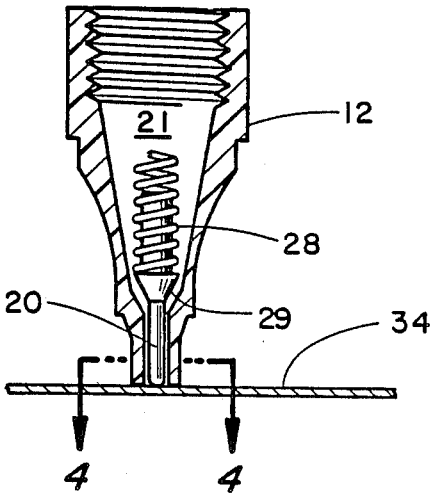
FIG. 2 is an enlarged, partial cross-sectional view illustrating the nozzle assembly of the pen with the applicator in the fluid application position.

As shown in FIG. 2, the applicator assembly may be pressed against a surface of paper 34 to cause the stylus 20 to retract into the cavity 21, against the force of the spring 28. This causes the conical portion 29 to unseat from the funnel-shaped portion 22 of carrier body 16 and, thereby, allows correction fluid to flow from cavity 21 through an annulus 35 existing between the tip 25 and the smaller cylindrical portion 24.

The application of the tip to paper 34 or other like surface opens a continuous flow path from the fluid reservoir 17 through the passage 33, cavity 21 and annulus 35. The path remains unobstructed so long as pressure is applied to the tip 25. The flow rate of the correction fluid is controlled and metered by the dimensions of the orifice 32 and the annulus 35. The cross-section and volume of annulus 35 must be minimized, in order to be able to apply extremely precise flow quantities of correction fluid, such as that which may be necessary to correct only a single typewritten letter, without covering adjacent lettering, and, as well, to minimize the area in which the correction fluid can be exposed to the atmosphere and cake. This factor, in turn, necessitates the use of correction fluid formulations having a minimum viscosity consistent with the need to achieve proper capacity to cover errors on the workpiece. Due to its small cross-sectional flow area, the annulus 35 will nevertheless be susceptible to clogging by minute residues of the correction fluid that may adhere to surfaces of the tip 25 or smaller cylindrical portion 24. Accordingly, positive means are needed to facilitate flow of the correction fluid, to inhibit caking, and to clear clogs which can nevertheless occur.

The correction fluid is a chlorinated-based fluid as is well known in the art, but is specially formulated so that the fluid contains no less than 70 percent liquid by weight.

It has been found that formulations in an amount of 40 percent liquid and 60 percent solid by weight are inoperable.

The barrel 10, in accordance with the invention, must be slightly squeezable, but not permanently deformable or collapsible, under normal conditions of manual usage. The barrel 10 preferably has a rectangular cross-section as the opposing flat sides will facilitate handling and the manual application of a slight squeezing finger pressure.

Many plastics, such as polyvinyl chloride, will not be both compatible with chlorinated correction fluids and, as well, resilient. However, barrels and tips formed from nylon-6 resin or Selar PA barrier resin, marketed by DuPont de Nemours and Company, have been found to perform satisfactorily in the chlorinated fluid environment An operable correction fluid pen, containing the chlorinated-based formulation, may be fabricated with a barrel and stylus made of nylon-6 resin with the specifications set forth in the following example. All dimensions are approximate.

| EXAMPLE I | | |
|---|---|---|
| Barrel | | |
| Length, end to end | 4.2 | inches |
| Cross-sectional length | 0.9 | inches |
| Cross-sectional width | 0.7 | inches |
| Wall thickness | 20 to 30 | mils |
| Bore, internal diameter | 0.35 | inches |
| Applicator assembly | | |
| Length | 1.2 | inches |
| Discharge opening diameter | 0.042 | inches |
| Annulus (opened area) | 0.001 | sq. in. |

Figure 3:
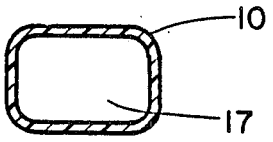
FIG. 3 is a sectional view taken along view lines 3—3 of FIG. 1.
Figure 4:
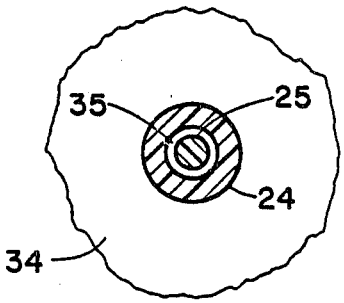
FIG. 4 is an enlarged sectional view taken along view lines 4—4 of FIG. 2.

In order for the pen to be squeezable, in accordance with the invention, the wall thickness of the barrel 10 must fall within the range of 20 mils to 30 mils. Barrels with a wall thickness exceeding 30 mils will not be readily squeezable under the application of a range of pressure normally expected to be exerted when the barrel is squeezed between a person's thumb and forefinger. The flexing of the wall and the resultant pressurization of the fluid in the fluid reservoir 13, responsive to such finger pressure, provides means for the fluid to clear clogs which may develop in the annulus 35 and, also, assists in providing a continuous flow for sustained applications of the correction fluid. However, if the wall thickness falls below 20 mils, the fluid reservoir may be over pressurized. The cross-section of the barrel is dimensioned so that, though squeezable under manual pressure, the opposing wall portions do not contact As shown in FIG. 3, the barrel preferably has a rectangular cross-section.

In order to use the pen, the user manually squeezes the barrel while pressing the tip 25 of stylus 20 against the surface which is to be covered, thereby causing fluid to pass through the annulus 35 and onto the surface. When the pen is used, the stylus is pressed upwardly, thereby unseating the conical portion 29 from the funnel-shaped portion 22. After the first use of the pen, a film of the correction fluid will begin to adhere to the surface of the stylus 20 and the internal surface of the tubular section 31. In the event that the annulus becomes clogged is a result, the squeezing of the walls of the barrel, on re-use, will facilitate the flow of the correction fluid. The manual pressure also causes the cavity 21 to continuously retain a reservoir of fluid so that a sustained application of the pen against and over the surface will not cause the pen to run dry or skip.

Referring now to FIGS. 5 through 8, where a preferred embodiment of the invention is illustrated, barrel 100 has a substantially rectangular cross section with opposite, squeezeable side walls 101. Side walls 101 are slightly curved to be convex outwardly from an interior reservoir 117, defined by the barrel 100. A first inwardly stepped border 104 extends around each side wall 101 and engages over a shoulder 106 of the barrel 100. A second inwardly stepped border 105 extends around the first border 104 and also extends over the shoulders 106. End walls 108 close the ends of the barrel and a bottom walls 110 closes the bottom of the barrel. Bottom wall 110 has a wall thickness which is large with respect to the wall thicknesses of side walls 101 with their borders 104 and 105. End walls 108 and shoulder 106 extend substantially perpendicularly to the side wall 101 and are relatively rigid with respect to the structure of the side walls. In this way, the side walls With their borders act as bellow structures to permit squeezing of the barrel 101.

Two mixing balls 107 are deposited in the reservoir 117, along with the correcting fluid having the formulation identified above. The mixing balls effectively mix the fluid when the barrel is shaken.

A neck 111 extends from the shoulders 106 and carries an external reverse male thread 153 on its exterior. A bore 115 is defined through the neck 111 for the passage of fluid from reservoir 117.

Flashing 155 which remains after the molding process, that forms the barrel 100, is retained at the base of neck 111 adjacent the shoulders 106. The purpose of this flashing will be explained later in connection with the applicator assembly 140.

An orifice assembly 130 has a cylindrical portion 131 which defines a passage 134 and which is inserted into the bore 115. A flange 136 on the outside of orifice assembly 130 is seated against the outer edge of neck 111. Cylindrical portion 131 has a small diameter portion **131*a* which is smaller in diameter than bore 115 to permit easy entry of the orifice assembly 31 into the bore 115. Positive seating is provided by a large diameter portion 131*b* which has an outer diameter that is substantially equal to the inside diameter of bore 115. The transition area between portions 131*a* and 131*b* is curved to permit smooth entry and full seating of orifice assembly 130 into neck 111**.

Cylindrical portion 131 also includes a second large diameter portion **131*c* which has an outer diameter that is substantially equal to the inner diameter of a cylindrical seat 146 in applicator assembly 140. A step 147 bounds one end of cylindrical seat 146 and is provided for engagement against one side of flange 136**.

Applicator assembly 140 includes a cavity 141 which communicates with cylindrical seat 146 and which includes an interior reverse female thread 152 that is threadable onto male thread 153 on neck 111. The orifice assembly 130 is thus securely held against axial movement between applicator assembly 140 and barrel 100 by virtue of the large diameter portions **131*b* and 131*c* and the flange 136**.

A boss 132 extends from the large diameter portion **131*c* and has an orifice 133 therethrough. Orifice 133 communicates with passage 134. Boss 132 has a small diameter portion 132*a* which has an outer diameter that is approximately equal to the inside diameter of a spring 128 which is seated around the small diameter portion 132*a*. Boss 132 also includes a large diameter portion 132*b* which defines a step with small diameter portion 132*a* against which spring 128** bears.

To advance a parallel flow of fluid along the passage 134, ribs 135 are provided in passage 134 which extend axially in the passage.

The opposite end of spring 128 is engaged with a solid stylus 120 for urging the stylus away from the orifice assembly 130.

Stylus 120 includes a stem 124 having a small diameter **124*a* which has an outside diameter which is smaller than the inside diameter of orifice 133. Stem 124 also includes a large diameter portion 124*b* which has an outside diameter which is substantially equal to the inside diameter of orifice 133. The small diameter portion or section 124*a* of stem 124 help meter the flow of fluid from orifice 133**.

Stylus 120 also includes a conical portion 129 which has a cylindrical portion 127 at its large diameter end, around which an end of spring 128 engages. Spring 128 also engages against centering and spring seating projections 123 which extend radially outwardly from conical portion 129. Conical portion 129 also carries a cylindrical portion 125 at its small diameter end which terminates in a conical tip 126.

The stylus 120 is seated within the cavity 141 of applicator assembly 140 with the conical tip 126 being urged into a discharge opening 144 at the end of applicator assembly 140. Applicator assembly 140 is provided with a funnel shaped portion 142 which terminates at a tapered tip 143 that tapers toward the discharge opening 144. With stylus 120 seated in applicator assembly 140, an annular, generally conical passage 149 is defined between the stylus and the interior of funnel shaped portion 142. When the applicator is pressed against a sheet of paper carrying an error to be corrected, the tip 126 of the stylus is pushed back to its phantom line position in FIG. 8. This opens an annular space between the conical tip 126 and discharge opening 144 which communicates with annular conical space 149 to permit the flow of correcting fluid from the applicator assembly.

Centering and spring seat projections 123 also help center the stylus 120 in the applicator assembly 140 while, at the same time, defining passages there between for the flow of fluid through the applicator assembly.

The inner surface of applicator assembly 140 is also provided with recesses 156 near the inner opening of cavity 141. At a point where applicator assembly is almost completely seated onto neck 111, these recesses cooperate with the flashing 155 to produce a snap action locking effect to help further secure the applicator assembly on the barrel. The reverse threading also avoids an inadvertent opening of the reservoir 117.

Returning to FIG. 8, it is noted that with the applicator assembly 140 fully mated on neck 111, the small diameter portion 124*a* of cylindrical portion 124 extends into orifice 133. When the applicator is pressed against a page to be corrected, the small diameter portion 124*a* is brought to its phantom line position in FIG. 8., closer to the orifice 133. This helps constrict any additional flow of fluid through orifice 133 to avoid the discharge of too much fluid, particularly when the barrel is squeezed.

The invention claimed is:

1. A correction fluid pen for applying a correction fluid of the type which includes an opaque covering pigment and a volatile solvent, the correction fluid pen comprising:

a barrel having a substantially rectangular cross section and a fluid chamber with an open end for retaining a reservoir of fluid, the barrel, including opposite substantially flat side walls, opposite substantially flat end walls connected between said side walls, a shoulder closing one end of said barrel and a bottom wall closing an opposite end of said barrel, and a bellows structure bounding at least a major portion of each side wall, said barrel being made of plastic material and said side walls and bellows structure being manually squeezable inwardly into said fluid chamber, said barrel including a neck extending from said shoulder and having a bore therethrough communicating with said fluid chamber;

a chlorinated-based solvent correction fluid contained in said fluid chamber;

an applicator assembly connected to said neck and including a cavity extending therethrough, said applicator assembly including a funnel shaped portion, said cavity including a conical passage extending through said funnel shaped portion and terminating at a discharge opening at an end of said funnel-shaped portion;

an orifice assembly seated between said neck and said applicator assembly in said bore of said neck and in said cavity of said applicator assembly, said orifice assembly, including a passage therethrough, communicating said fluid chamber with said conical passage;

a solid, elongated stylus, slidably mounted in said applicator assembly, said stylus having a top engagable into said discharge opening for closing said discharge opening and being retractable into said conical passage to define an annular space between said tip and said discharge opening for the discharge of correction fluid through said annular space, said stylus including a cylindrical portion connected to said tip and defining an annular passage with said funnel-shaped portion of said applicator assembly in said conical passage;

spring means engaged with said stylus for urging said stylus into engagement with the applicator assembly to close said discharge opening against a discharge of fluid; and a boss extending from said orifice assembly toward said discharge opening, said spring means comprising a spring having one end engaged around at least a portion of said boss, said boss having an orifice therethrough communicating with said passage in said orifice assembly, said stylus having a conical portion with a small diameter end connected to said cylindrical portion of said stylus, and a large diameter end, at least one spring stop projection on said conical portion of said stylus adjacent said large diameter end thereof, said spring having an opposite end engaged around said large diameter end of the conical portion of said stylus, said stylus including a cylindrical stem extending from said large diameter end of said conical portion of said stylus, at least a portion of said stem extending into said orifice for metering a flow of correction fluid through said orifice.

2. A correction fluid pen according to claim 1, wherein said bellows structures each comprise a first inwardly stepped border, extending around at least a part of each side wall and a second inwardly stepped border extending inwardly and around at least a part of each first inwardly stepped border.

3. A correction fluid pen according to claim 2, wherein each of said first and second inwardly stepped borders extend over said shoulder.

4. A correction fluid pen according to claim 2, wherein said bottom wall of said barrel has a thicker material thickness than said side walls of said barrel.

5. A correcting fluid pen according to claim 1, wherein said portion of said stem includes a small diameter portion having an outside diameter which is smaller than an inside diameter of said orifice, at least a part of said small diameter portion of said stem extending into said orifice, said stem, including a large diameter portion between said small diameter portion and said large diameter end of said conical portion of said stylus, movable toward said orifice against the bias of said spring when said tip of said stylus is retracted away from said discharge opening of said applicator assembly.

6. A correction fluid pen according to claim 1, wherein said orifice assembly includes a cylindrical portion and a flange at an intermediate axial location along said cylindrical portion, said flange being engaged against said neck, said applicator assembly including a cylindrical seat in said cavity bounded by a step, said flange being engaged against said step, said cylindrical portion of said orifice assembly being closely engaged into said bore of said neck on one side of said flange and into said cylindrical seat of said applicator assembly on an opposite side of said flange.

7. A correction fluid pen according to claim 6, including a plurality of axially extending ribs connected to said orifice assembly, extending into said passage of said orifice assembly.

8. A correction fluid pen according to claim 6, including at least one mixing ball in said fluid chamber of said barrel for facilitating mixing of correction fluid in said chamber.

9. A correction fluid pen according to claim 6, wherein said stylus includes a plurality of said spring stop projections extending outwardly therefrom and in said conical passage of said applicator assembly for centering said stylus in said applicator assembly.

10. A correction fluid pen according to claim 6, wherein said barrel includes flashing projections at a base of said neck adjacent said shoulder of said barrel, said applicator assembly having an inner opening for receiving said neck with a plurality of circumferentially spaced recesses in said opening for engagement with said flashing projections to facilitate a snap locking of said applicator assembly on said neck, said neck and applicator assembly having mated threads for retaining said applicator assembly on said neck.

11. A correction fluid pen according to claim 10, wherein said threads are service threads.

12. A correction fluid pen according to claim 6, wherein said cylindrical portion of said orifice assembly engaged into said bore of said neck includes a small diameter portion for facilitating entry of said cylindrical portion into said neck, and a large diameter portion for closely engaging against said neck.

13. A correction fluid pen according to claim 1, wherein said chlorinated-based solvent correction fluid contains at least seventy percent by weight of liquid.

* * * * *